United States Patent [19]

Hirakawa et al.

[11] Patent Number: 4,627,831

[45] Date of Patent: Dec. 9, 1986

[54] SINGLE FACER

[75] Inventors: Tadashi Hirakawa; Kiyomitsu Yoshikawa; Shigenari Yoshioka; Hiroaki Sasashige, all of Mihara, Japan

[73] Assignee: Mitsubishi Jukogyo Kabushiki Kaisha, Tokyo, Japan

[21] Appl. No.: 681,785

[22] Filed: Dec. 14, 1984

[30] Foreign Application Priority Data

| | | | |
|---|---|---|---|
| Jan. 20, 1984 | [JP] | Japan | 59-7083 |
| May 2, 1984 | [JP] | Japan | 59-64994[U] |
| May 2, 1984 | [JP] | Japan | 59-64995[U] |
| May 2, 1984 | [JP] | Japan | 59-64996[U] |

[51] Int. Cl.[4] ..... B31F 1/28; B31B 1/88

[52] U.S. Cl. ..... 493/337; 493/381; 493/477; 493/463; 156/205; 156/470; 156/472; 72/239; 72/197

[58] Field of Search ..... 72/239, 238, 197; 493/463, 435, 403, 381, 468, 470, 471, 473, 475, 477, 478, 479, 480, 337; 156/205, 470, 471, 472

[56] References Cited

U.S. PATENT DOCUMENTS

| | | | |
|---|---|---|---|
| 3,390,040 | 6/1968 | Moser et al. | 156/473 |
| 3,638,468 | 2/1972 | Fukui | 72/239 |
| 3,747,387 | 7/1973 | Shumaker | 72/239 |
| 4,222,258 | 9/1980 | Field | 72/239 |
| 4,471,515 | 9/1984 | Takenaka et al. | 493/463 |
| 4,481,066 | 11/1984 | Hirakawa et al. | 156/472 |
| 4,569,714 | 2/1986 | Tokuno | 156/471 |

FOREIGN PATENT DOCUMENTS

| | | | |
|---|---|---|---|
| 036830 | 11/1975 | Japan | 72/239 |
| 2114929 | 9/1983 | United Kingdom | 72/239 |

*Primary Examiner*—Francis S. Husar
*Assistant Examiner*—William E. Terrell
*Attorney, Agent, or Firm*—Wenderoth, Lind & Ponack

[57] ABSTRACT

A single facer including a main frame installed on a base for supporting a paste application roll, a pressure roll and so on, a movable frame fixed on or removably supported on the main frame for rotatably supporting upper and lower corrugated rolls in meshing engagement with each other, and a transfer mechanism for moving the movable frame in a transverse direction substantially in the axial direction of the respective upper and lower rolls to transfer them out of or into the main frame.

11 Claims, 12 Drawing Figures

SINGLE FACER

BACKGROUND OF THE INVENTION

1. Field of the Invention

The present invention relates to a single facer and, more particularly, to a single facer in a corrugating machine for making a single-faced corrugated sheet composed of one corrugated core paper sheet and one liner adhered to the former.

2. Description of the Prior Art

FIG. 1 shows a single facer for use in a corrugating machine of the prior art. A core paper sheet 4 is introduced into a meshing point, at which upper and lower rolls 1 and 2 having their respective corrugated surfaces mesh, so that the sheet is formed into a corrugated shape. Next, the crest portions of the corrugations on one side of the corrugated core paper sheet 4 are made to contact with the surface of a paste application roll 7 so that they are covered with paste. Then, the core paper sheet 4 has its crest portions pressed by a pressure roll 3 and the lower corrugated roll 2 onto a liner 5 fed from another direction until it is worked into a single-faced corrugated sheet 8. The upper corrugated roll 1 is borne rotatably on an arm 9 by means of a bearing. The arm 9 has its one end hinged swingably to a fulcrum frame 11 by means of a pivot pin 10 and its other end hinged through a pin 14 to the piston rod 13*a* of a pressure cylinder 13. The pressure cylinder 13 is connected to a bracket 12 which is fastened to the frame 11. The lower corrugated roller 2 has its bearing fastened between the frame 11 and the bracket 12. And, the upper corrugated roll 1, the lower corrugated roll 2 and the pressure roll 3 are heated by introducing steam into the inside thereof so as to promote the shaping of the core paper sheet 4 and the adhesion by the paste.

In order to change the height and pitch of the corrugations of the core paper sheet 4 of a corrugated board, it is necessary to replace the upper corrugated roll 1 and the lower corrugated roll 2. In the single facer of the prior art described above, more specifically, pipings or the like for introducing the steam into the bracket 12, the pivot pin 10 and the upper and lower corrugated rolls 1 and 2 have to be disassembled so that the upper and lower rolls 1 and 2 may be replaced. Moreover, the disassembly has to be postponed for one or two days because the upper and lower rolls 1 and 2 and their peripheral devices are cooled down from their hot temperatures during the run of the single spacer.

SUMMARY OF THE INVENTION

It is, therefore, an object of the present invention to provide a single facer having upper and lower corrugated rolls which may be exchanged in a short time period.

Another object of the present invention is to provide a single facer having upper and lower corrugated rolls which may be exchanged without any difficulty.

Still another object of the present invention is to provide an inexpensive single facer which is enabled to make several kinds of single-faced corrugated sheets of different corrugations at an arbitrary time.

According to a feature of the present invention, there is provided a single facer comprising: a main frame installed on a base for bearing a paste application roll, a pressure roll and so on; a movable frame fixed on or made removable from said main frame for bearing an upper corrugated roll and a lower currugated roll in meshing engagement with each other; and transfer means for moving said movable frame in a transverse direction substantially in the axial direction of the respective ones of said rolls to transfer the same out of or into said main frame.

BRIEF DESCRIPTION OF THE DRAWINGS

Other objects and features of the present invention will become more apparent from the following description taken in conjunction with one embodiment thereof with reference to FIG. 2 and so on of the accompanying drawings, in which.

DESCRIPTION OF THE PREFERRED EMBODIMENT

Figure 1:
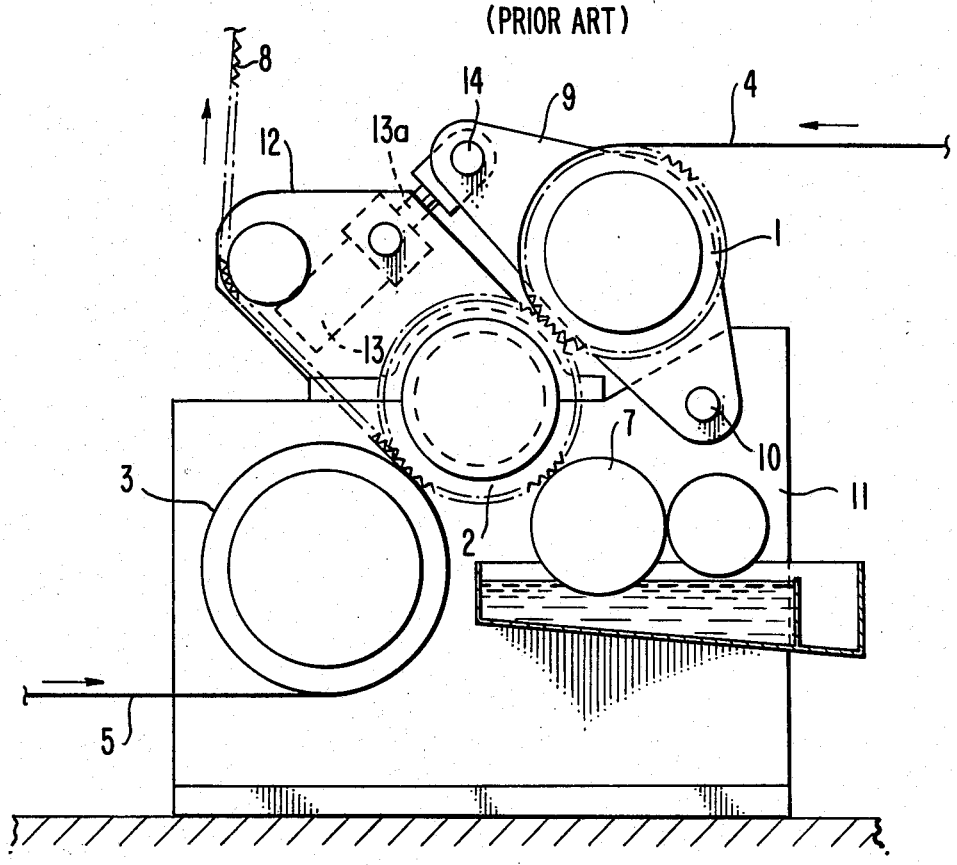
FIG. 1. (PRIOR ART)
FIG. 1 is a schematic side elevation showing the single facer according to the prior art.
Figure 2:
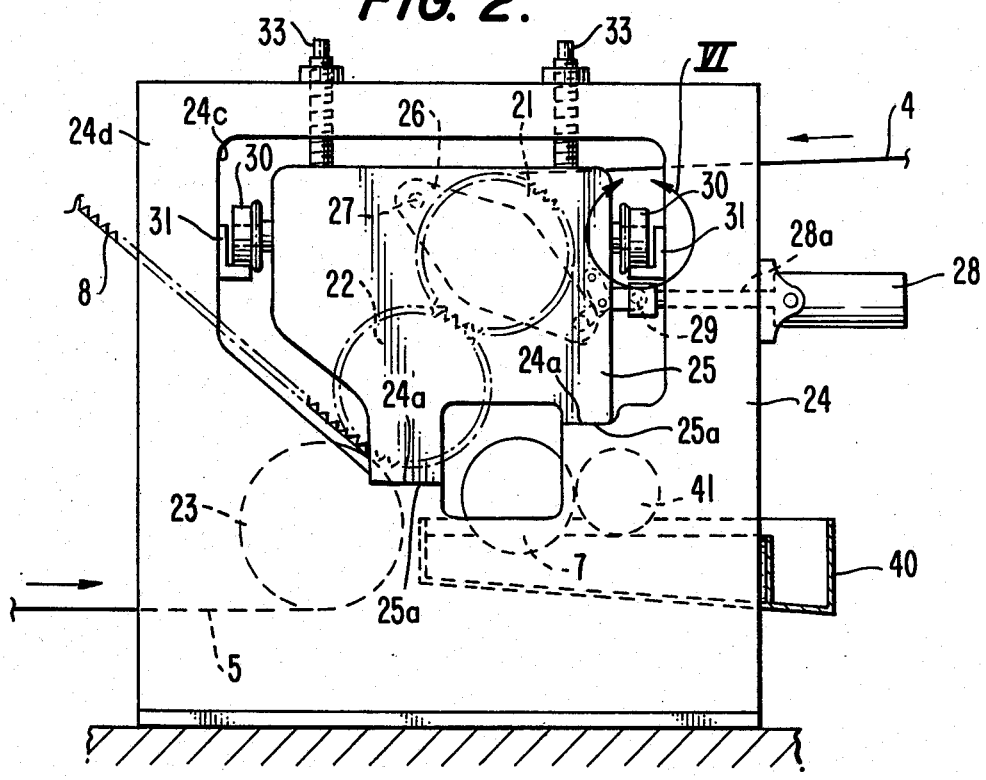
FIG. 2 is similar to FIG. 1 but shows a single facer according to the present invention.

On a movable frame 25, as shown in FIG. 2, there are carried an upper roll 21 and a lower roll 22 which have their respective surfaces corrugated. A pressure roll 23, a paste application roll 7, a paste pan 40, a doctor roll 41 and so on are borne on a main frame 24 which is installed on a base.

Figure 3:
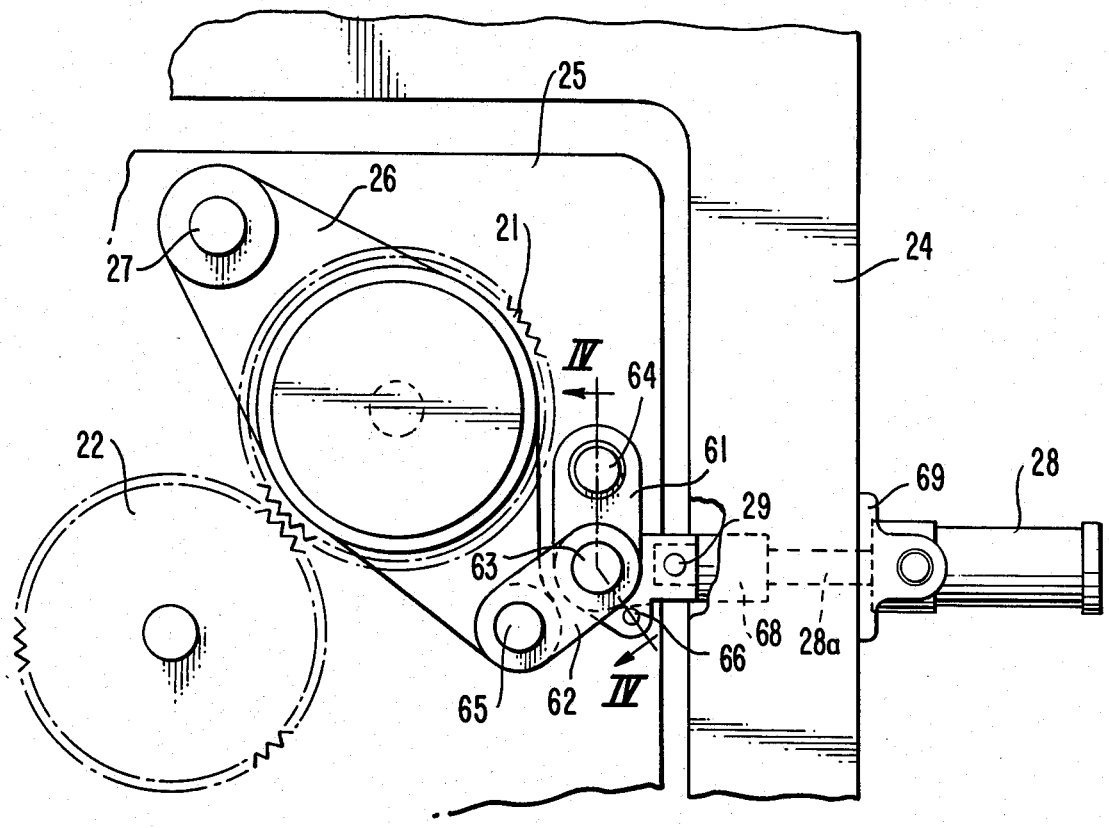
FIG. 3 is an enlarged view showing a portion of FIG. 2.
Figure 4:
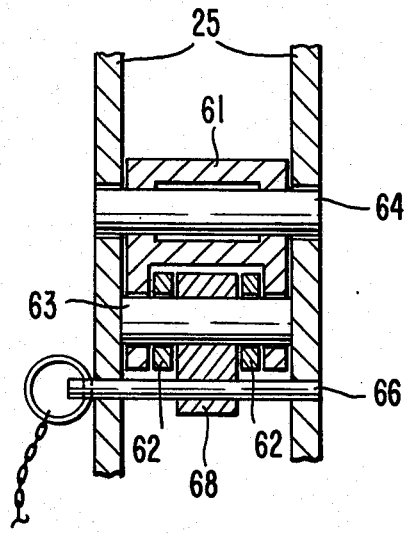
FIG. 4 is a section taken along line IV—IV of FIG. 3.

The upper corrugated roll 21 is borne rotatably through a bearing in an arm 26, which has its one end hinged to the movable frame 25 by means of a pivot pin 27, as is apparent from FIGS. 3 and 4. The other end of the arm 26 is hinged by means of a pin 65 to a link 62, which is hinged by a pin 63 to a link 61 and a connecting member 68. Moreover, the link 61 is hinged by a pin 64 to the movable frame 25, whereas the connecting member 68 is connected by means of a pin 29 to the cylinder rod 28*a* of a pressure cylinder 28. This pressure cylinder 28 is hinged swingably by means of a bracket 69 to the main frame 24. By extending the cylinder rod 28*a* of the pressure cylinder 28 in the state described above, the arm 26 is rocked on the pivot pin 27 through the pin 29, the connecting member 68, the pin 63, the link 62 and the pin 65 so that the upper corrugated roll 21 is pressed onto the lower corrugated roll 22. The connecting member 68 and the movable frame 25 are connected to each other by fitting a connecting pin 66 which is slidably held in the movable frame 25. By extending the cylinder rod 28*a* of the pressure cylinder in the abovespecified state, the movable frame 25 can be pushed leftwardly of FIG. 3.

Figure 5:
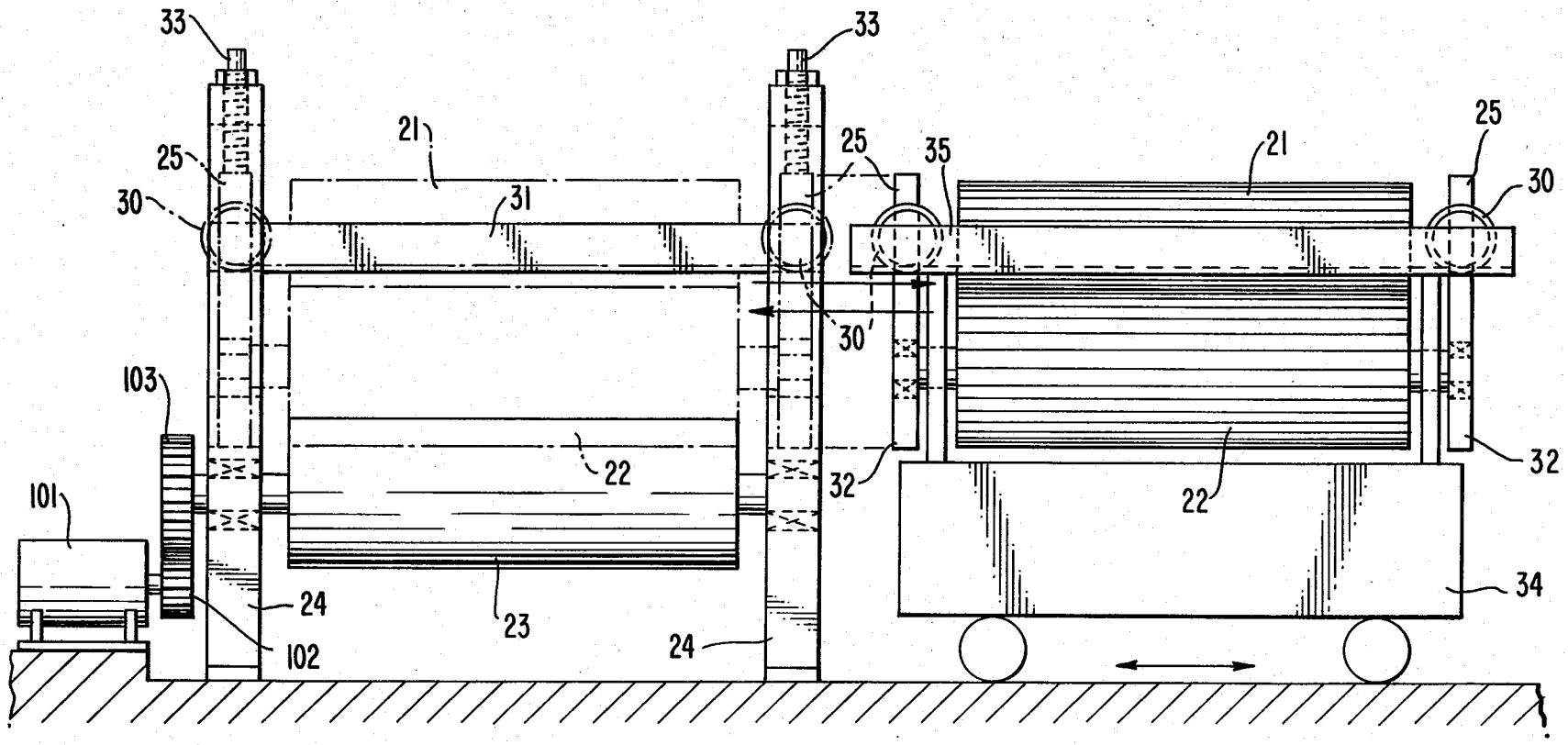
FIG. 5 is a schematic front elevation showing replacement of rolls.
Figure 6:
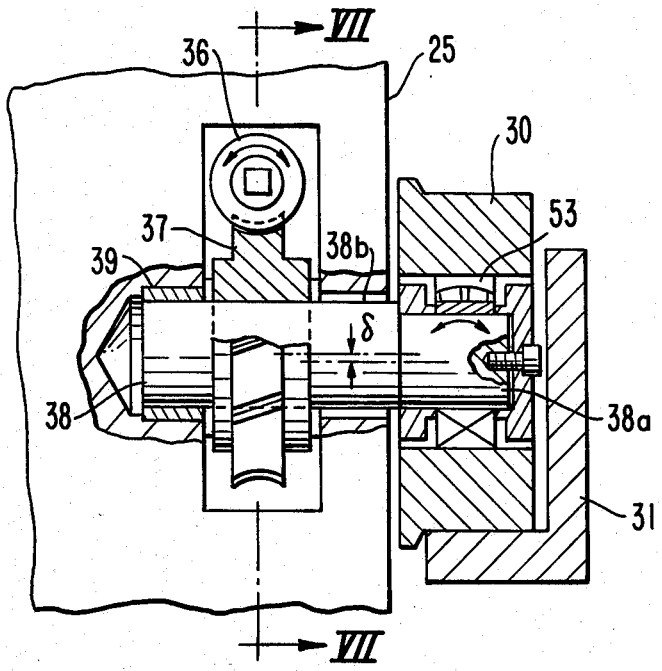
FIG. 6 is a partially cut-away, enlarged view showing a portion VI of FIG. 2.
Figure 7:
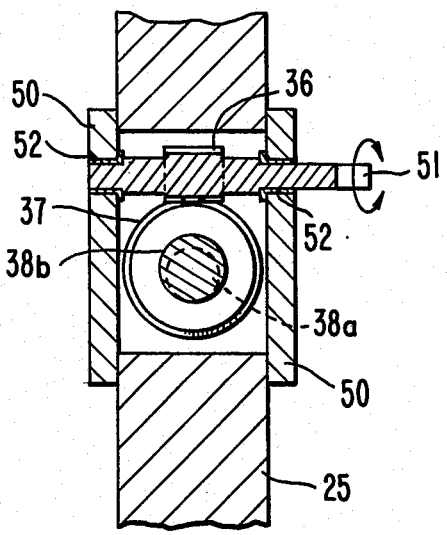
FIG. 7 is a section taken along line VII—VII of FIG. 6.

As is apparent from FIGS. 2 and 5, the movable frame 25 is equipped with a transfer means including a plurality of wheels 30, which are adapted to roll, while supporting the movable frame 25, on rails 31 (which are also part of the transfer means) placed on the main frame 24, as shown in FIG. 5, and extending generally horizontally along the axial direction of the respective rolls to openings 24*c* in the side portions 24*d* of the main frame 24 at the right ends thereof. Each of the wheels 30 is rotatably supported, as shown in FIGS. 6 and 7, by means of an automatic centering bearing 53 in an eccentric portion 38*a* of a wheel axle 38 which is borne rotatably by means of a bearing 39 in the movable frame 25. To a worm wheel bearing portion 38*b* of the wheel axle 38, there is splined a worm wheel 37, with which a worm 36 meshes and is splined at the center of a worm shaft 51. This worm shaft 51 is borne rotatably at both its ends through bearings 52 in a mounting plate 50, which in turn is fixed on the movable frame 25. The axis of the eccentric portion 38*a* of the wheel axle 38 is eccentric by a distance $\delta$ from the worm wheel bearing portion 38*b*. As a result, if the wheel axle 38 is rotated through the worm 36 and the worm wheel 37 by rotating the worm shaft 51, as shown in FIGS. 8 and 9, the wheels 30 are moved up and down by the distance $\delta$ so that the movable frame 25 is moved vertically relative to the main frame 24.

Figure 8:
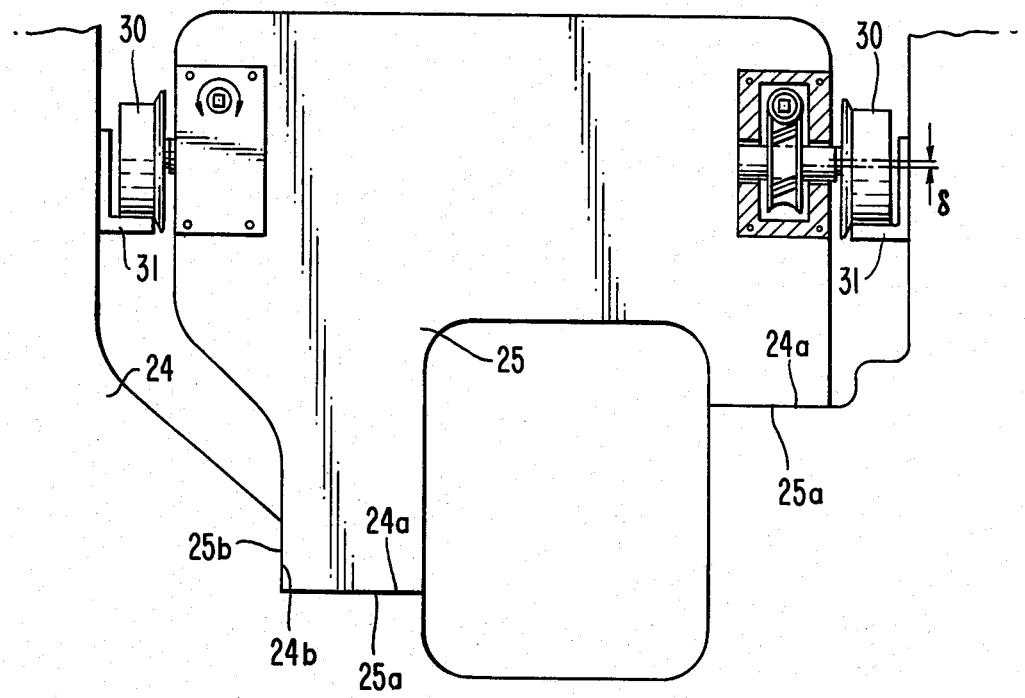
FIG. 8 is a schematic side elevation showing the state in which a movable frame is fixed on a main frame.
Figure 9:
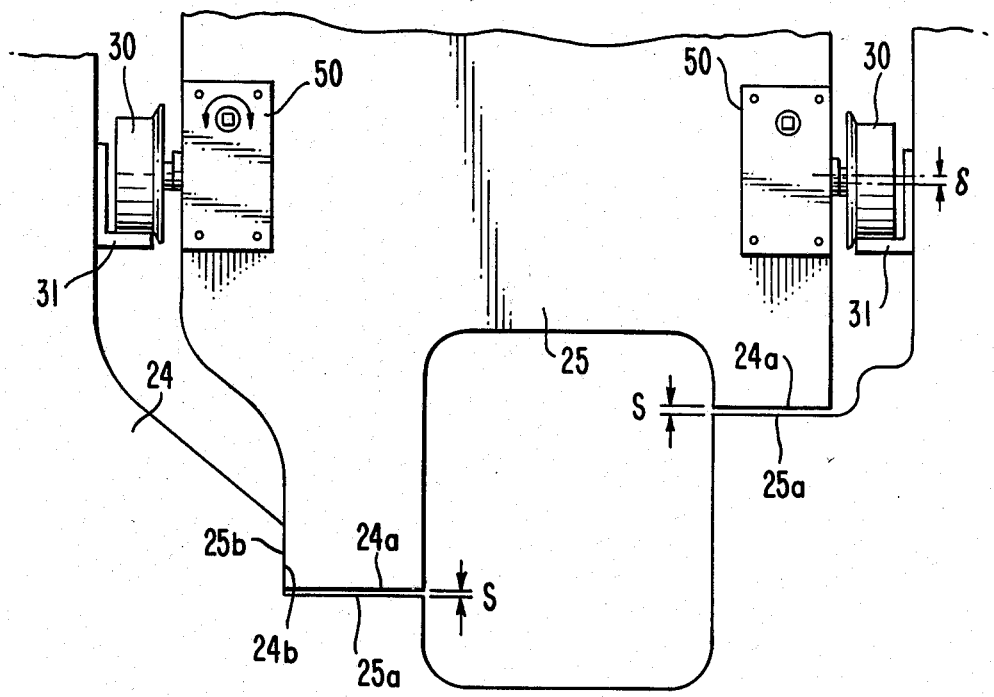
FIG. 9 is a schematic side elevation showing the state in which the movable frame is lifted up from the main frame.

The movable frame 25 is formed, as shown in FIGS. 8 and 9, with a horizontal reference surface 25*a* at its lower end and a vertical reference surface 25*b* at its one side edge. The movable frame 25 and the main frame 24 are fixed in a predetermined positional relationship to each other by bringing these horizontal and vertical reference surfaces 25*a* and 25*b* into close contact or alignment with horizontal and vertical reference surfaces 24*a* and 24*b* which are formed on the main frame 24, and by screwing push bolts 33, which are anchored at the main frame 24, to fasten the main frame 24 and the movable frame 25 with surfaces 24*a* and 25*a* in contact with each other, as shown in FIG. 8.

Figure 10:
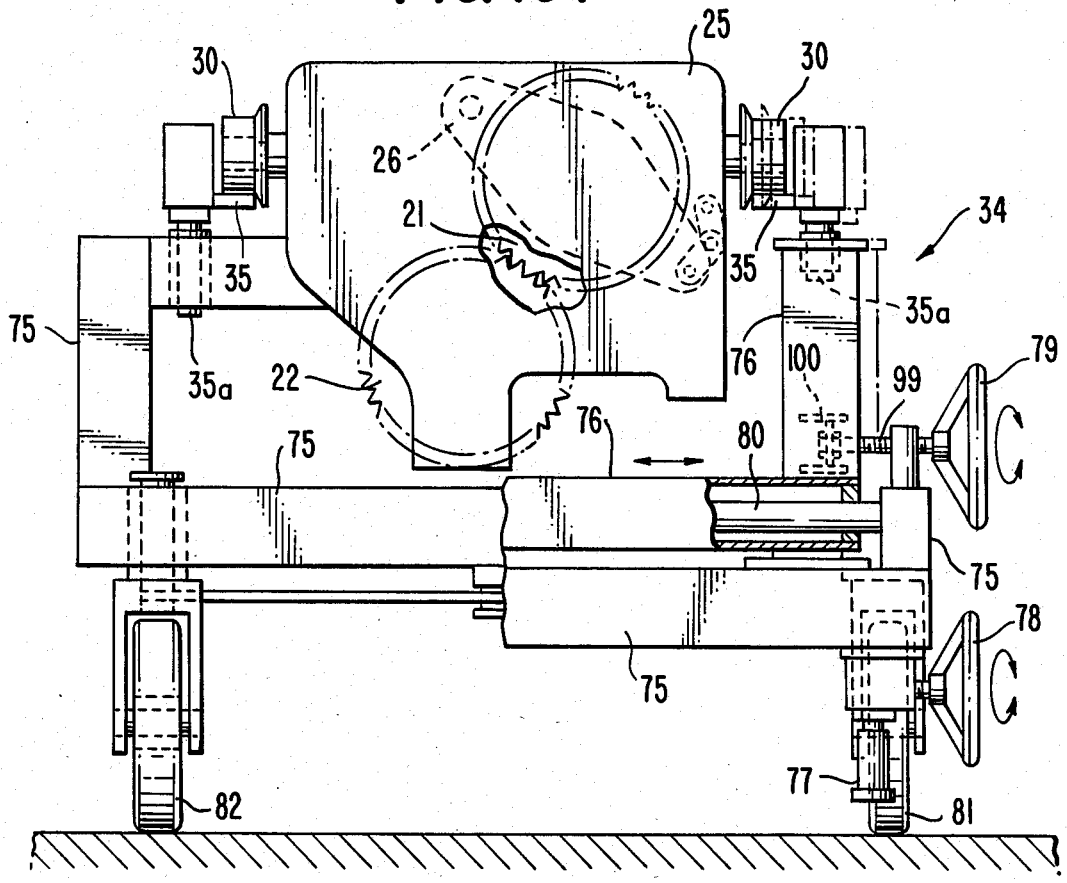
FIG. 10 is a righthand side elevation and a partially cut-away lefthand side elevation showing, in left and right halves, respectively, a truck which is loaded with the movable frame.
Figure 12:
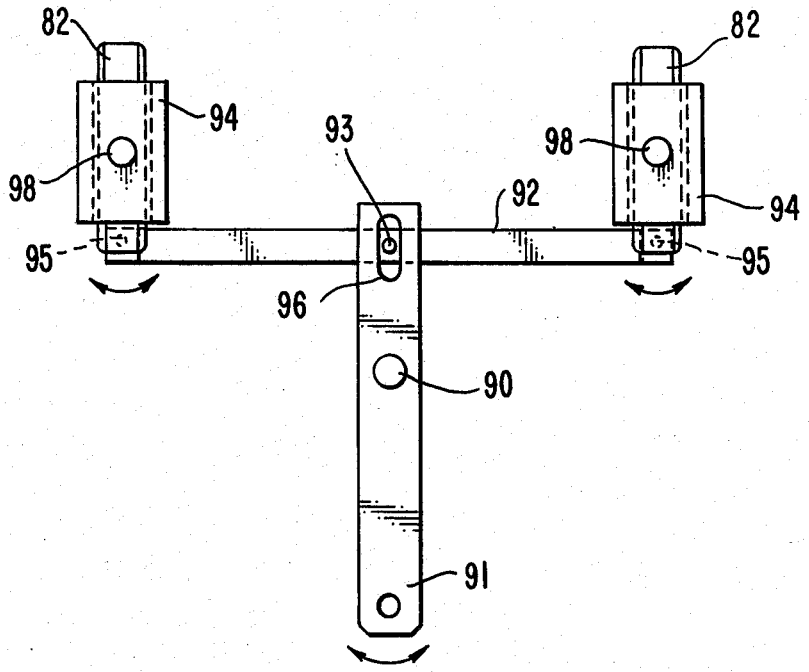
FIG. 12 is an explanatory view showing the steering mechanism of the truck.
Figure 11:
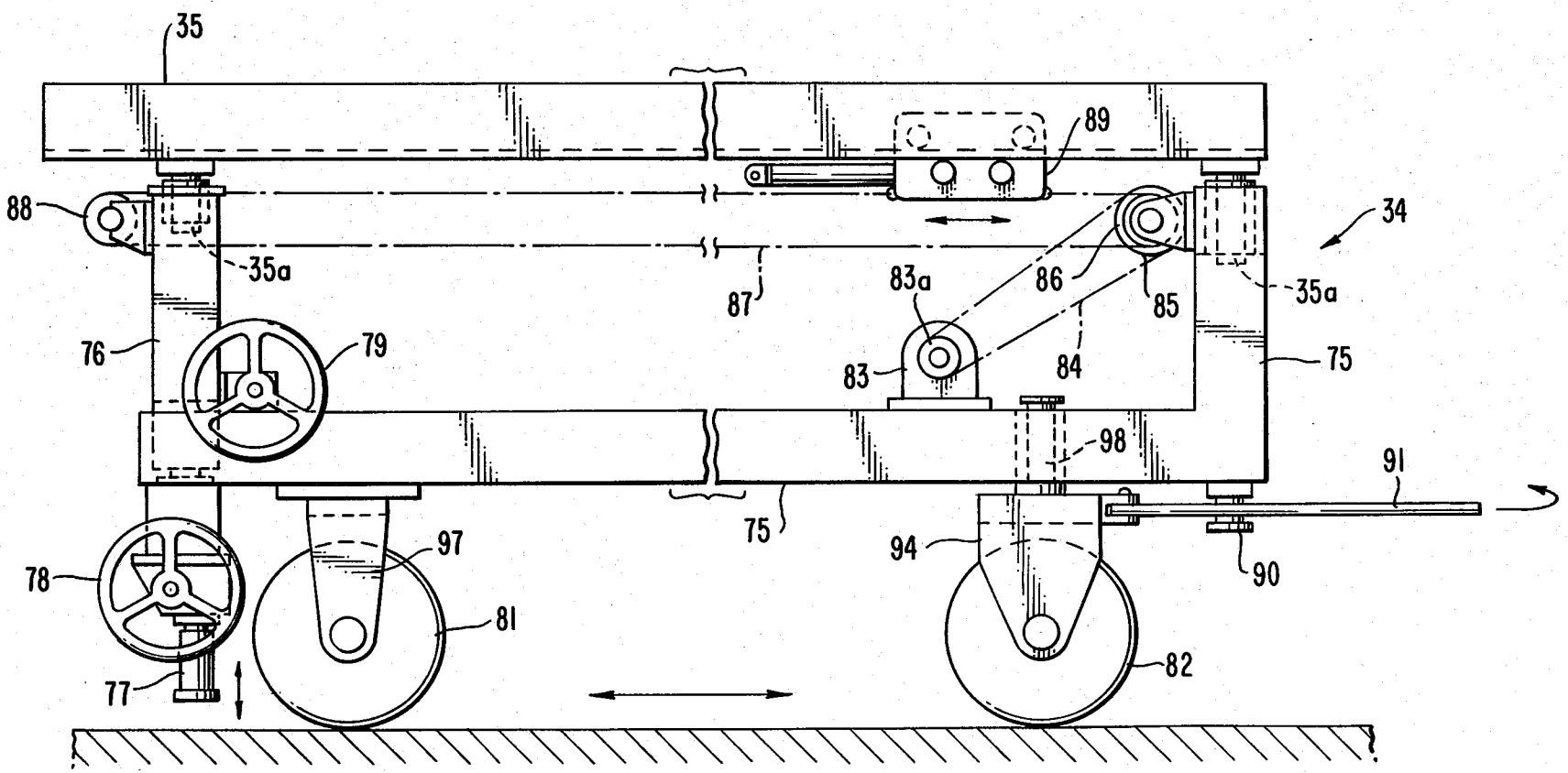
FIG. 11 is a front elevation showing the truck.

A truck for transferring the movable frame 25 to and from the main frame 24 is indicated at reference numeral 34 in FIGS. 5, 10 and 11. As better seen from FIGS. 10 and 11, front wheels 81 are borne rotatably through brackets 97 in the lower portion of the front end of a main bed 75 of the truck 34, and rear wheels 82 are borne rotatably through brackets 94 in the lower portion of the rear end of the same. The right and left brackets 94 are hinged, as shown in FIG. 12, through pins 95 to both the ends of a rod 92, and a pin 93 anchored at the center of the rod 92 is fitted in a slot 96 which is formed in the end portion of a steering arm 91. Those right and left brackets 94 are hinged swingably on vertical pins 98, respectively, and the steering arm 91 is hinged swingably on a vertical pin 90. As a result, the right and left brackets 94 are swung on the vertical pins 98 through the slot 96, the pin 93, the rod 92 and the pins 95 by swinging the steering arm 91 about the vertical pin 90 so that the rear wheels 82 are steered. To the lower portion of the front end of the main bed 75, there are mounted screw jacks 77 which can be moved up and down by turning a handle 78. A movable bed 76 is borne slidably to the right and left on a spindle 80 which is fixed to the upper portion of the front end of the main bed 75. By turning a handle 79 which is fixed to the right end of a threaded shaft 99 screwed in the main bed 75, a bracket 100 jointed loosely to the left end of the threaded shaft 99 can be moved to the right or left to move the movable bed 76, which is fixed on the bracket 100, along the spindle 80. Rails 35 are so supported between the upper portion of the rear end of the main bed 75 and the upper portion of the movable bed 76 that they can turn around vertical pins 35*a*. Those rails 35 extend generally horizontally at substantially the same height as that of the rails 31 which are laid on the main frame 24. A carrier 89, which is borne to move on the rails 35, is fixed to a chain 87. This chain 87 is carried between a sprocket wheel 85, which is borne rotatably in the upper portion of the rear end of the main bed 75, and a sprocket wheel 88 which is borne rotatably in the upper portion of the movable bed 76. Another chain 84 is carried on a sprocket wheel 86, which is fixed to the shaft of the sprocket wheel 85, and a sprocket wheel 83*a* which is fixed to the output shaft of a motor 83 placed on the main bed 75. Thus, by the forward and backward rotations of the motor 83, the carrier 89 is moved back and forth along the rails 35 through the sprocket wheel 83*a*, the chain 84, the sprocket wheel 85, the sprocket wheels 86, 88 and the chain 87.

When it is intended to run the single facer thus constructed, as shown in FIG. 2, means for fixing the movable frame 25 and the main frame 24 with respect to each other in the predetermined positional relationship is provided by screwing the push bolts 33. Also, the cylinder rod 28*a* of the pressure cylinder 28 is extended to press the upper corrugated roll 21 onto the lower corrugated roll 22. Then, the lower corrugated roll 22, the upper corrugated roll 21, the paste application roll 7 and the doctor roll 41 are rotated, as shown in FIG. 5, by starting a motor 101 to rotate the pressure roll 23.

As a result, the core paper sheet 4 is introduced into the meshing point between the upper roll 21 and the lower roll 22 so that it is worked into a corrugated shape. Then, the paste is applied to the crest portions of the corrugations of the currugated core paper sheet 4 by the action of the paste application roll 7. After this, the corrugated core paper sheet 4 thus pasted is pressed by the lower roll 22 and the pressure roll 23 onto the liner 5, which is introduced from a different direction, so that it is adhered to the latter to form the single-faced corrugated sheet 8. In case the upper roll 21 and the lower roll 22 being used are to be replaced by another set of upper and lower rolls having different crest heights and pitches, the push bolts 33 are first loosened, and the pin 29 is pulled out to disconnect the connecting member 68 from the cylinder rod 28*a*. After this, by rotating the worm shaft 51 and accordingly the wheel axle 38 through the worm 36 and the worm wheel 37 thereby to push the wheels 30 downward, the movable frame 25 is lifted by a distance S from the main frame 24, as shown in FIG. 9, so that it is placed on the rails 31. As shown in FIG. 5, on the other hand, an empty truck 34 is brought close to the side of the main frame 24, and the handle is then turned to drop the jacks 77 so that the rails 35 are brought to the same level as that of the rails 31. Next, by turning the handle 79 to move the movable bed 76 to the right or left, the rails 31 and the rails 35 are brought together in the transverse direction. Then, the motor 83 is started to move the carrier 89 toward the main frame 24, and is then attached at its leading end portion to the movable frame 25. Then, by reversing the motor 83, the movable frame 25 is pulled off of the rails 31 and moved onto the rails 35. After the truck 34 under consideration is shifted to another place, another identical truck 34, on which is placed the movable frame 25 carrying the upper and lower corrugated rolls 21 and 22 having the different crest heights and pitches, is brought close to the side of the main frame 24. By the procedures reversed from the aforementioned ones, moreover, the movable frame 25 is forced into the main frame 24 until its stopper 32 comes into abutment against the side of the main frame 24. Then, by rotating the worm shaft 51 to retract the wheels 30 upward with respect to the movable frame 25, the movable frame 25 is moved down to bring its horizontal reference surface 25*a* into close contact with the horizontal reference surface 24*a* of the main frame 24. At this time, the connecting member 68 and the cylinder rod 28*a* are connected by means of the pin 29, and the connecting member 68 and the movable frame 25 are hinged together through the connecting pin 66. In this state, by extending the cylinder rod 28*a* of the pressure cylinder 28, the movable frame 25 is pushed to have its vertical reference surface 25*b* contacting closely with the vertical reference surface 24*b* of the main frame 24. Then, by fastening the means for retaining the movable frame 25, i.e. the push bolts 33, as shown in FIG. 2, the movable frame 25 and the main frame 24 are fixed in their predetermined positional relationship in which the reference planes 25*a* and 25*b* of the former are in close contact with the reference planes 24*a* and 24*b* of the latter. Then, by extracting the pin 66 to disconnect the movable frame 25 and the connecting member 68, the replacement of the upper and lower rolls 21 and 22 is ended.

Incidentally, if the movable frame 25 unloaded from the truck 34 is replaced by another by means of a crane or the like, the single truck 34 is sufficient for practising the present invention.

In the embodiment thus far described, on the other hand, the pressure cylinder 28 is attached to the main frame 24. Alternatively, the pressure cylinder 28 can be attached to the movable frame 25. Moreover, the wheels 30 carrying the movable frame 25 are made to roll on the rails 31 and 35 in the foregoing embodiment but may be replaced by sliders. Alternatively, rails may be fixed on the movable frame 25 which are made to run on rollers which are borne on the main frame 24.

According to the single facer thus constructed, the paired corrugated different upper and lower rolls are carried in meshing engagement on the movable frame, and this movable frame is replaced by another in its entirety. This makes it unnecessary to disassemble the various parts so that the time period for exchanging the upper and lower rolls is shortened markedly and so that the works for the roll replacement are simplified. Moreover, the cost for the facilities can be dropped remarkably because single-faced corrugated sheets having different corrugations can be produced at an arbitrary time by the use of only one single facer. Still moreover, any doubled facilities can be excluded to raise the economy because the pressure cylinder for pressing the upper roll onto the lower roll is used to position the movable frame. Furthermore, the sub bed is attached to the main bed of the truck in a transversely movable manner so that the rails can have their transverse positions adjusted with ease. This makes it unnecessary to be cautious in steering the heavy truck so that the truck can be moved readily to an operative position to shorten the working time period.

Although the present invention has been described hereinbefore in connection with the embodiment thereof, it should not be limited to such embodiment but can be modified in various designs if the modifications are within the spirit of the present invention.

What is claimed is:

1. A single facer comprising:

a main frame;

a paste application roll rotatably supported on said main frame, said paste application roll having a roll axis extending in a transverse direction;

a pressure roll rotatably supported on said main frame, said pressure roll having a roll axis which is parallel to said transverse direction;

a movable frame movable in said transverse direction between a fixed position on said main frame for making a single-faced corrugated sheet and a position off of said main frame;

a lower corrugated roll rotatably supported on said movable frame, said lower corrugated roll having a roll axis parallel to said transverse direction;

an upper corrugated roll rotatably mounted on support means pivotally mounted on said movable frame, said upper corrugated roll having a roll axis parallel to said transverse direction, means on said main frame for supporting said movable frame in said fixed position on said main frame; and transfer means for moving said movable frame in said transverse direction between a position vertically above said fixed position at which said movable frame is supported by said main frame and said position off of said main frame at which said movable frame is not supported by said main frame for replacing said movable frame with another movable frame having corrugated rolls with corrugations of a different height and pitch, said transfer means including means on one of said main frame and said movable frame for moving said movable frame vertically between said position vertically above said fixed position and said fixed position on said main frame for making single-faced corrugated sheet.

2. The single facer of claim 1, wherein said main frame has reference surfaces and said movable frame has reference surfaces which correspond to said reference surfaces of said main frame when said movable frame is moved to said fixed position for making single-faced corrugated sheet.

3. The single facer of claim 2, wherein said reference surfaces of said main frame comprise a horizontal reference surface for use in adjusting a vertical position of said movable frame and a vertical reference surface for use in adjusting a horizontal position of said movable frame along said transverse direction.

4. The single facer of claim 1, wherein said transfer means comprises at least one rail extending in said transverse direction and supported on said main frame and at least one wheel rotatably supported on said movable frame for movably supporting said movable frame on said at least one rail of said main frame.

5. The single facer of claim 4, further comprising a truck having means for moving said movable frame onto and off of said at least one rail of said main frame.

6. The single facer of claim 5, wherein said means for moving said movable frame onto and off of said at least one rail of said main frame includes at least one rail movably mounted on said truck and means on said truck for moving said at least one rail of said truck vertically and horizontally to align with said at least one rail of said main frame.

7. The single facer of claim 6, wherein said truck further includes a carrier for moving a movable frame onto said truck and for moving a movable frame from said truck onto said main frame.

8. The single facer of claim 4, wherein said at least one wheel is eccentrically mounted on an axle rotatably supported on said movable frame, said axle having a worm wheel fixedly secured thereto, said movable frame having a worm engaging said worm wheel and a worm shaft extending from said worm wheel for rotating said axle to thereby move said at least one wheel vertically up or down with respect to said movable frame whereby said movable frame is shifted vertically with respect to said main frame.

9. The single facer of claim 1, further comprising means mounted on said main frame for pressing said upper corrugated roll into contact with said lower corrugated roll and means associated with said main frame and said movable frame for fixing said movable frame with respect to said main frame for maintaining said movable frame at said fixed position for making single-faced corrugated sheet.

10. The single facer of claim 1, wherein said main frame includes side portions at either end thereof which are normal to said transverse direction, said side portions having openings therein, said means on said main frame for supporting said movable frame comprises horizontal surfaces defining bottom sides of said openings and said movable frame includes lower horizontal surfaces for contacting said horizontal surfaces of said main frame to thereby position said movable frame in said fixed position for making single-faced corrugated sheet, said means for moving said movable frame in a vertical direction moves said horizontal surfaces of said movable frame into contact with said horizontal surfaces of said main frame.

11. The single facer of claim 10, wherein said transfer means includes at least one rail extending in said transverse direction and supported on said main frame and at least one wheel rotatably supported on said movable frame for movably supporting said movable frame on said at least one rail and said means for raising and lowering said movable frame in a vertical direction includes means for eccentrically mounting said at least one wheel on an axle which is rotatably supported on said movable frame, said axle having a worm wheel fixedly secured thereto, said movable frame having a worm engaging said worm wheel and a worm shaft extending from said worm wheel for rotating said axle to thereby move said at least one wheel vertically up or down with respect to said movable frame whereby said movable frame is shifted vertically with respect to said main frame.

* * * * *